US009428971B2

(12) United States Patent
Pyörny

(10) Patent No.: US 9,428,971 B2
(45) Date of Patent: Aug. 30, 2016

(54) ROCK DRILLING UNIT AND METHOD OF CHANGING DRILL RODS

(71) Applicant: Sandvik Mining and Construction Oy, Tampere (FI)

(72) Inventor: Ilmo Pyörny, Tampere (FI)

(73) Assignee: SANDVIK MINING AND CONSTRUCTION OY, Tampere (FI)

( * ) Notice: Subject to any disclaimer, the term of this patent is extended or adjusted under 35 U.S.C. 154(b) by 330 days.

(21) Appl. No.: 14/173,987

(22) Filed: Feb. 6, 2014

(65) Prior Publication Data

US 2014/0224540 A1 Aug. 14, 2014

(30) Foreign Application Priority Data

Feb. 8, 2013 (EP) ..... 13154608

(51) Int. Cl.

| | |
|---|---|
| ***E21B 19/16*** | (2006.01) |
| ***E21B 7/02*** | (2006.01) |
| ***E21B 15/04*** | (2006.01) |
| ***E21B 19/15*** | (2006.01) |
| ***E21B 19/20*** | (2006.01) |

(52) U.S. Cl.

CPC ..... *E21B 19/16* (2013.01); *E21B 7/025* (2013.01); *E21B 15/04* (2013.01); *E21B 19/15* (2013.01); *E21B 19/20* (2013.01)

(58) Field of Classification Search

CPC ..... E21B 19/16; E21B 19/20; E21B 7/025

See application file for complete search history.

(56) References Cited

U.S. PATENT DOCUMENTS 6,634,443 B1 * 10/2003 Paech ..... E21B 15/04 175/85

2009/0277626 A1 11/2009 Littlely

FOREIGN PATENT DOCUMENTS

| | | | |
|---|---|---|---|
| EP | 0389288 | A1 | 9/1990 |
| GB | 2169334 | A | 7/1986 |
| GB | 2312006 | A | 10/1997 |
| WO | 0065193 | A1 | 11/2000 |

* cited by examiner

*Primary Examiner* — David Andrews

(74) *Attorney, Agent, or Firm* — Corinne R. Gorski

(57) ABSTRACT

A rock drilling unit and a method of changing drill rods in a rock drilling unit is disclosed. The rock drilling unit includes a feed beam, a retainer device, a rock drilling machine and at least one clamp. The clamp is operable without driving force of the drilling unit. The clamp has a space for receiving one single drill rod. The clamp is positioned at a side position, which is parallel to a drilling axis and is at a transfer distance from the drilling axis.

15 Claims, 3 Drawing Sheets

ROCK DRILLING UNIT AND METHOD OF CHANGING DRILL RODS

RELATED APPLICATION DATA

This application claims priority under 35 U.S.C. §119 to EP Patent Application No. 13154608.7, filed on Feb. 8, 2013, which the entirety thereof is herein incorporated by reference.

BACKGROUND

The disclosure relates to a rock drilling unit, and particularly to an arrangement for changing drill rods in the rock drilling unit. The rock drilling unit includes a feed beam and a rock drilling machine arranged movably on the feed beam. The rock drilling machine has a shank for connecting drill rods to the drilling axis. Further, at least one retainer device is arranged on the feed beam.

The disclosure further relates to a method of changing drill rods in the rock drilling unit.

In mines and other work sites rock drilling rigs are used for drilling bore holes on rock surfaces. Typically the rock drilling rig includes one or more drilling booms which are provided with drilling units. In many cases drill holes having a greater length than one drill rod need to be drilled. Then two or more drill rods need to be connected to each other in order to form an extension rod. This is called extension rod drilling. Typically several drill rods are stored in a rod magazine which is arranged in the drilling unit. However, the rod magazine is large and heavy, whereby it may hamper the drilling.

SUMMARY

An aspect of the invention is to provide a novel and improved rock drilling unit provided with change means and a method of changing drill rods.

The rock drilling unit is provided with at least one clamp allowing one single drill rod at a time to be retained at a predetermined side position, which is parallel to the drilling axis and is located at a transverse distance from the drilling axis; and the retaining feature of the clamp is independent of the driving force external to the clamp.

The method is characterized by supporting one single drill rod at a time at the side position by means of at least one clamp.

The present rock drilling unit has at least one clamp device allowing one single drill rod at a time to be retained at a predetermined side position, which is parallel to the drilling axis defined by a drilling machine and is located at a transverse distance from the drilling axis. The clamp device includes at least one clamp for holding the drill rod. Further, the retaining feature of the clamp is operable without any driving force external to the clamp. Thus the clamp may be without any connection to a pressure fluid or electric circuit.

An advantage of the disclosed solution is that the clamp is simple in structure and operation, whereby it is reliable and inexpensive. Since the clamp does not need any external driving power, it is operable while the drilling unit is shut down. Thereby it is safe to place a drill rod manually in the clamp or to remove it.

According to an embodiment, the rock drilling unit is without any drill rod magazine or storage device for storing more than one single drill rod. Instead, the present solution relates to a holder which influences only one single drill rod at a time. Thanks to the disclosed solution, more than one drill rods can be drilled successively, and still, there is no need to provide the rock drilling unit with any conventional rod magazine. Thus, the rock drilling unit may be lightweight. The reach of a drilling boom may be dimensioned extensive when a lightweight rock drilling unit does not limit the range of the boom.

According to an embodiment, the clamp is provided with an inside space for receiving a drill rod. The shape of the inside space may be substantially cylindrical, which is beneficial since the outer surfaces of the drill rods are typically cylindrical, too. The dimensions of the space enlarge when a drill rod is placed inside the space. Thus, the space has initial first dimensions and second dimensions when a drill rod is placed inside the space, the second dimensions being larger than the first dimensions.

According to an embodiment, the clamp includes contact surfaces which are pressed against an outer surface of a retained drill rod when the rod is placed between the contact surfaces. Thanks to the continuous press force, the retained drill rod holds its position firmly and does not vibrate and cause noise. A further advantage is that outer dimensions of the drill rod may vary and the clamp still holds drill rods properly.

According to an embodiment, the clamp is spring-actuated, comprising one or more spring elements for producing the needed press force. Because of the spring element, the clamp is independent and operable without any driving force external to the clamp. Further, the clamp adjusts itself automatically according to the outer dimensions of the retained drill rod. The spring may be spiral spring, leaf spring or any other suitable spring type. Alternatively, the spring actuation may be formed by a pressure-medium-operated actuator, such as a pressure air cylinder.

According to an embodiment, the clamp is made of resilient material for producing the needed press force. Because of the spring actuation achieved by the resilient material, the clamp is independent and operable without any driving force external to the clamp. The resilient material may comprise polyurethane (PUR) or other plastic material, for example. Alternatively, the resilient material may comprise rubber or polymeric material.

According to an embodiment, changing drill rods includes the following actions: connecting the drilling unit to an inoperational state; feeding the drill rod manually to the clamp when the drilling unit is off; and retaining the drill rod in the clamp by an internal spring force.

According to an embodiment, at least two clamps are arranged at a distance from each other as seen in the longitudinal direction of the feed beam. This embodiment enables secure and stabile support for a retained drill rod. A first clamp and a second clamp may be located at distances from the distal ends of a feed beam.

According to an embodiment, the clamp has a relatively large axial extent in the direction of the drill rod to be handled, whereby one single clamp may be sufficient to support and retain the drill rod. The clamp may be dimensioned to be relatively wide. This embodiment may be beneficial in situations when there is no space for several clamps.

According to an embodiment, the clamp is supported to the feed beam by means of at least one support element. The support element may be solid or movable.

According to an embodiment, the clamp is immovably supported to the feed beam by means of at least one support element. Thus, the clamp is stationary in the mentioned side position.

According to an embodiment, the clamp is movable in the transverse direction of the feed beam from the side position towards the drilling axis. Thanks to this embodiment, the clamp can be extended closer to an operator, which facilitates placing drill rods in the clamp and removing the rod from the clamp. Safety and working conditions are also improved.

According to an embodiment, the clamp is movable in the transverse direction of the feed beam from the side position to the drilling axis, and vice versa.

According to an embodiment, the rock drilling unit includes a support arm connected to the feed beam by means of articulation. The clamp is arranged at a distal end portion of the support arm. The support arm is provided with a turning device for turning the support arm in the transverse direction relative to the feed beam from the side position to the drilling axis and vice versa.

According to an embodiment, the rock drilling unit has at least one changing device. The changing device includes: a body connected movably to the feed beam; and gripping means allowing the drill rods to be gripped and released. Further, the changing device includes one or more transfer devices for moving the changing device in the transverse direction relative to the feed beam and positioning the gripping means at the side position and the drilling axis. The changing device may be controlled by the operator or it may execute the needed transfer operations under automatic control of one or more control units. The changing device may be connected to the feed beam by means of articulation, whereby the distal end of the changing device can be turned between the side position and the drilling axis.

According to an embodiment, the rock drilling unit includes at least one changing device provided with openable and closable gripping jaws. The gripping jaws serve as gripping means so that rotation of gripped drill rods can be prevented when opening and closing connecting threads, for example.

According to an embodiment, the clamp is arranged to support the drill rod at the side position and the changing device is arranged to move the drill rod between the side position and the drilling axis.

According to an embodiment, the clamp is supported to the changing device, whereby it is transversally movable together with the changing device. Thus, changing drill rods may comprise the following actions: moving the drill rods between the drilling axis and the side position by means of a changing device arranged movably relative to the feed beam; and moving the clamp between the drilling axis and the side position together with the changing device.

According to an embodiment, the clamp is arranged on the changing device pivotably so that the clamp can pivot relative to the body of the changing device. The clamp may have an initial position where it is kept by means of spring means. If necessary, the clamp may turn relative to the body of the changing device when the drill rod is handled. The spring means turn the clamp back to the original position after the external force directed to the clamp is terminated. An advantage of the pivoted connection is that it allows some inaccuracy in the transfer movements, and inaccuracy between the clamp and the drill rod.

According to an embodiment, the clamp serves as gripping means of the changing device.

According to an embodiment, the changing device includes the gripping jaws and the clamp. The gripping jaws serve as gripping means, whereas the clamp is mainly for holding the rod at the side position when the gripping jaws are open. The clamp allows the operator to place the drill rod in a correct position in the side position. The drill rod is held in that position until the operator leaves the vicinity of the drilling unit and switches the drilling unit to an operable state. Then the changing device is powered and the gripping jaws may be closed. The operator controls the operation of the changing device from a safe distance.

According to an embodiment, the rock drilling unit includes at least one additional support, which is rigidly fastened to a feed beam. The additional support may serve as an aid to guide a drill rod. The additional support is located in such a way that it is at a distal end of the drill rod. The additional support may include a protrusion so that a tubular drill rod can be first pushed around the protrusion. Secondly, the drill rod can be pushed laterally towards the one or more clamps for retaining the drill rod. The additional support facilitates handling of long drill rods.

According to an embodiment, the drilling unit includes several clamps arranged in such a way that at least two drill rods can be retained. However, each clamp influences one drill rod only. This embodiment allows placing 2 to 4 drill rods in the vicinity of drilling axis without a need to provide the drilling unit with a complicated, large-sized and heavy rod magazine.

Above-disclosed embodiments can be combined in order to form suitable solutions provided with necessary features.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION

Figure 1:
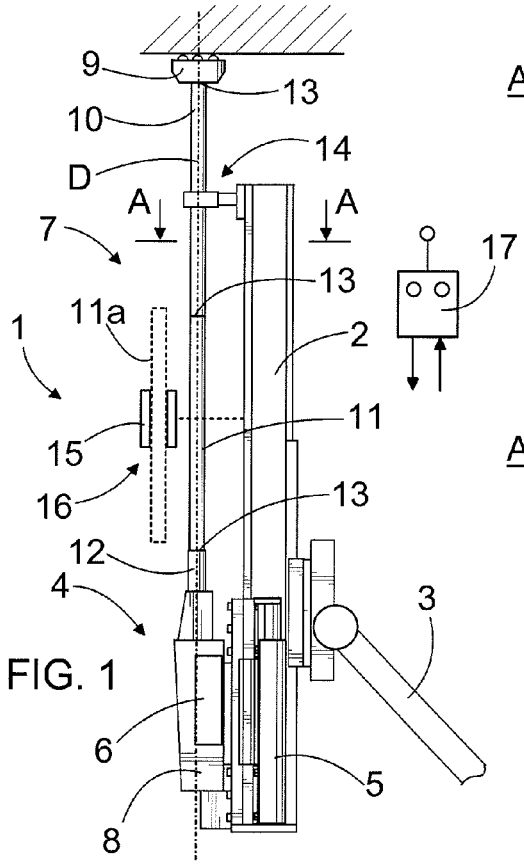
FIG. 1 is a schematic side view showing a rock drilling unit.

FIG. 1 shows a rock drilling unit 1 which may be connected by means of a boom 3 to a movable carrier, which is not shown. The drilling unit 1 includes a feed beam 2 provided with a rock drilling machine 4 that can be moved on the feed beam 2 by means of a feed device 5. The rock drilling machine 4 has a percussion device 6 for generating impact pulses on a tool 7, and a rotating device 8 for rotating the tool 7.

At a drilling site, one or more drill holes are drilled with the drilling unit 1. The drill holes may be drilled in the vertical direction, as shown in FIG. 1.

When a drill hole having a length longer than one single rod needs to be drilled, then an extension rod system is formed by connecting two or more drill rods successively. Typically the extension system formed of two drill rods is sufficient. Then, the tool 7 includes a drill bit 9, a first drill rod 10 and a second drill rod 11. At the beginning of drilling the drill bit 9 is connected to the distal end of the first drill rod 10, and the opposite end of the first drill rod 10 is connected to a shank 12 of the drilling machine 4. After the drilling of the first drill rod 10 is completed, the second drill rod 11 is connected to the shank 12 and the first drill rod 10. Between the first and second rods 10, 11, between the first rod 10 and the drill bit 9, and between the second rod and the shank 12, there are connecting means, such as connecting screws 13. The connecting screws 13 can be closed and opened by means of the rotating device 8. When connecting and disconnecting components of the tool 7, a retaining device 14 may be utilized for preventing rotation of tool components. The retaining device 14 is mounted on the feed beam 3 so that it is located on the drilling axis D. The retaining device 14 has retaining jaws or corresponding means for gripping the tool component. The retaining device 14 further includes one or more actuators for generating the needed retaining force.

The rock drilling unit 1 is provided with one or more clamps 15, which are arranged at the transverse direction from the drilling axis D. As it is shown in FIG. 1, one single clamp 15 may be adequate to hold a drill rod 11*a* at a side position 16 in a parallel direction relative to the drilling axis D. The clamp 15 is dimensioned relatively wide, whereby sufficient support is achieved for the second drill rod 11*a* placed in the clamp 15. Alternatively, two or more clamps may be arranged at a selected distance from each other for supporting the same drill rod 11*a* in the side position 16. The second drill rod 11*a* can be placed in the clamp 15 manually. During the manual operation, the rock drilling unit 1 may be shut down for safety reasons. The clamp 15 can operate independently of the drilling unit 1, whereby the drill rod 11*a* may be left in the clamp 15. Thereafter the operator may close a feasible safety cage and switch on the rock drilling unit 1 by means of a control unit 17. The operator controls the drill rod change operations manually by means of the control unit 17, or alternatively the control unit 17 may have one or more automatic control programs for controlling the drill rod changing measures.

Figure 2A:
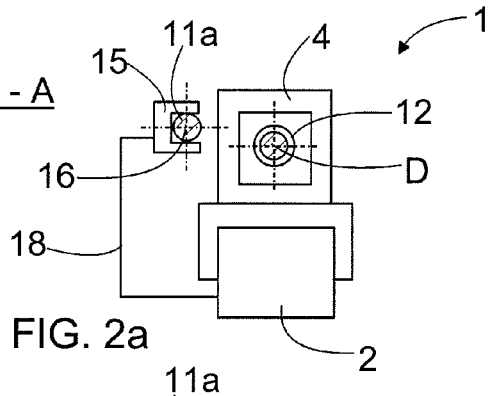
FIGS. 2*a* and 2*b* are schematic views showing two alternative rock drilling units at position A-A.
Figure 2B:
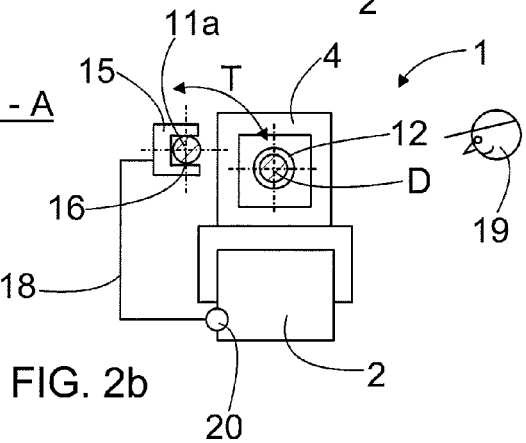

FIGS. 2*a* and 2*b* illustrate two alternative rock drilling units seen from their front sides. The clamp 15 may be supported on the feed beam 2 by means of a support element 18. In FIG. 2*a* the support element 18 is solid. For clarity reasons, FIG. 2*a* does not show a transfer device by means of which the second drill rod 11*a* can be moved from the side position 16 to the drilling axis D. However, the transfer device may be an articulated manipulator, robot arm or any other suitable device. In FIG. 2*b* the support element 18 can be turned T from the side position 16 towards the drilling axis D, and vice versa. It is possible to transfer the second drill rod 11*a* to the drilling axis D, or alternatively, it is possible to turn T the support element 18 only by a desired distance towards the drilling axis D and simultaneously closer to the operator 19 on the opposite side of the feed beam 2. In the latter case, the clamp 15 is moved within the reach of the operator, whereby handling of the drill rod is facilitated. The support element 18 is connected to the feed beam 2 by means of one or more pivots 20.

Figure 3:
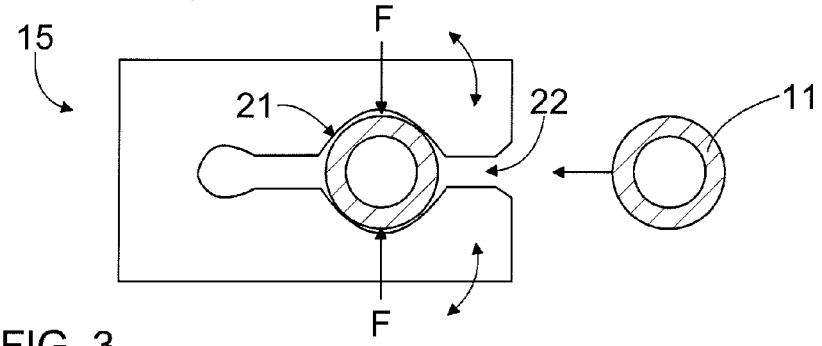
FIG. 3 is a schematic side view showing a clamp formed of resilient material.

FIG. 3 discloses a clamp 15 manufactured of resilient material, such as polymeric material. The clamp 15 has a space 21 where a drill rod 11 can be pushed through an inlet opening or slot 22. Surfaces of the space 21 serve as contact surfaces against the drill rod 11. When the rod 11 is inserted into the clamp 15, the resilient material will allow the clamp 15 to form according to the drill rod 11, as illustrated by arrows.

Figure 4:
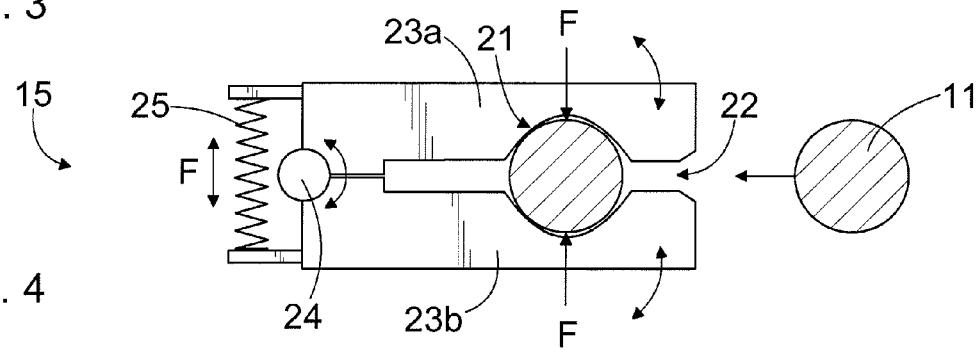
FIG. 4 is a schematic side view showing a clamp provided with a spring element.

FIG. 4 discloses an alternative clamp 15 which includes two clamp arms 23*a* and 23*b* connected to each other by means of a pivot 24. The clamp arms 23*a*, 23*b* are pressed towards each other by means of one or more spring elements 25. The clamp arms 23*a*, 23*b* are provided with curved contact surfaces which form together a space 21 for a drill rod 11. When the rod 11 is inserted into the clamp 15, the clamp arms 23*a*, 23*b* will part from each other under the influence of the spring element 25, as illustrated by arrows.

Figure 5:
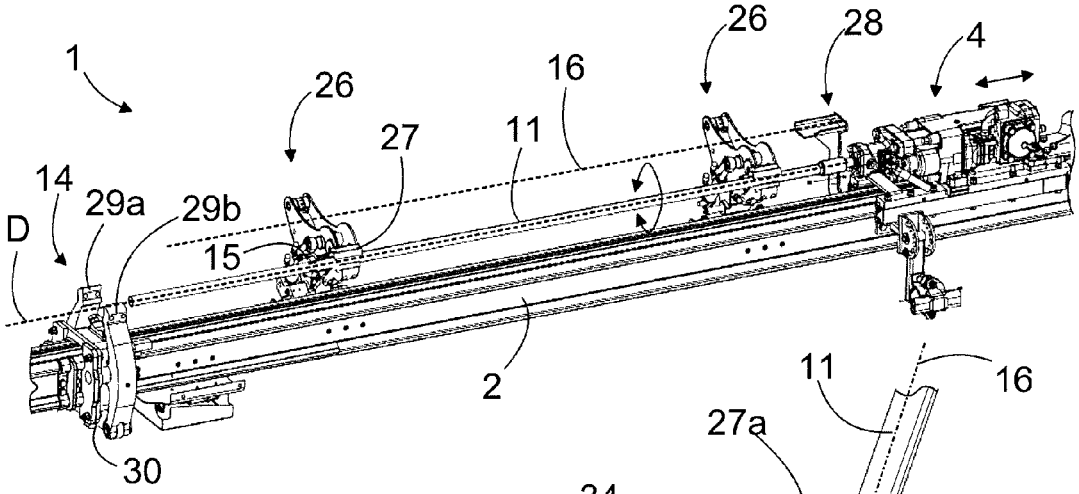
FIG. 5 is a schematic view showing a rock drilling unit and two transfer devices arranged on a feed beam.

FIG. 5 shows a rock drilling unit 1 provided with two changing devices 26 arranged on a feed beam 2 and located at an axial distance from each other. The changing device 26 may be arranged pivotably on the feed beam 2, whereby it can be turned between the drilling axis D and the side position 16. The changing device 26 may comprise gripping means or jaws 27 for gripping drill rods 11. Further, a clamp 15 may be arranged on the changing device 26, whereby the clamp 15 is arranged to move together with the changing device 26 between the drilling axis D and the side position 16.

The rock drilling unit 1 may further include an additional support 28, which may be mounted on the feed beam 2. The additional support 28 may be a solid object which may facilitate manual handling of the drill rod and especially serve as a suitable guide for the drill rod when it is placed in the clamp 15.

FIG. 5 further shows an example of a structure of a retaining device 14. The retaining device 14 may comprise retaining jaws 29*a*, 29*b* which are moved by a hydraulic cylinder 30.

Figure 6:
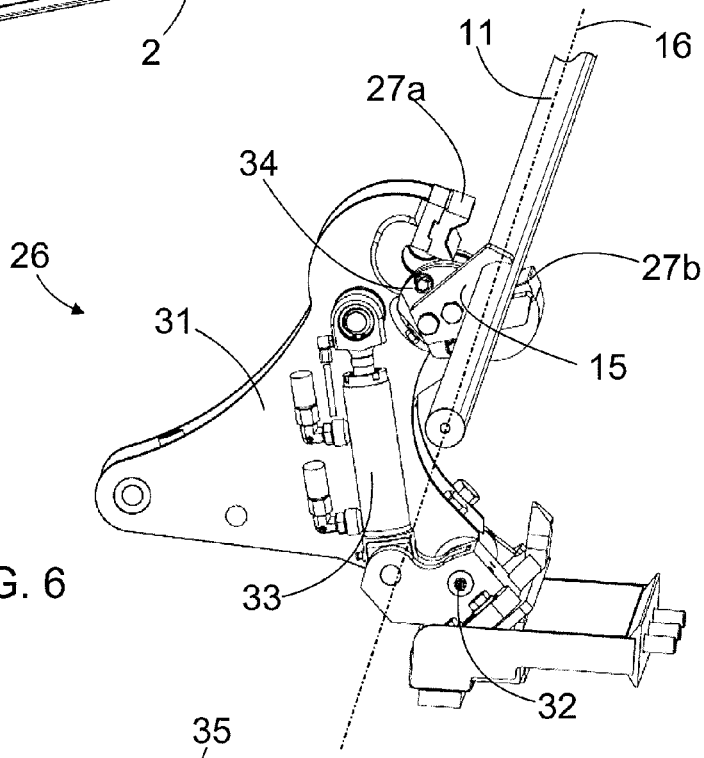
FIG. 6 is a schematic view showing a transfer device which is provided with a clamp.

FIG. 6 discloses a changing device 26 on a side position 16. Gripping jaws 27*a*, 27*b* are open and a drill rod 11 is in a clamp 15. A body 31 of the changing device 26 may be turned relative to a pivot 32 by means of a turning cylinder 33. Further, the clamp 15 may be arranged to the body 31 via a turning member 34. The turning member 34 has a spring element 35 keeping the clamp 15 in the initial position. The spring element 35 can be seen in FIG. 7.

Figure 7:
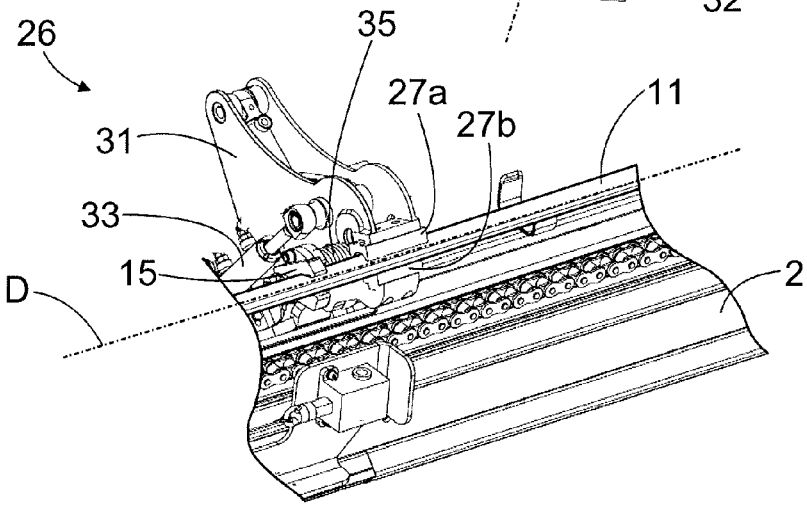
FIG. 7 is a schematic view showing a drill rod supported to the drilling axis by means of a clamp and gripping jaws of a transfer device.

In FIG. 7 the changing device 26 is turned to the drilling axis D and a drill rod 11 is supported by gripping jaws 27*a*, 27*b*. Also, the clamp 15 is still around the drill rod 11. After the drill rod 11 has been coupled to a shank of a drilling machine, the gripping jaws 27*a*, 27*b* are opened and the changing device 26 is turned back to a side position. As the changing device 26 is turned back, the clamp 15 releases the drill rod 11. Similarly, when the changing device 26 is turned towards a drill rod situated in the drilling axis D, the clamp 15 becomes automatically positioned around the drill rod.

Figure 8:
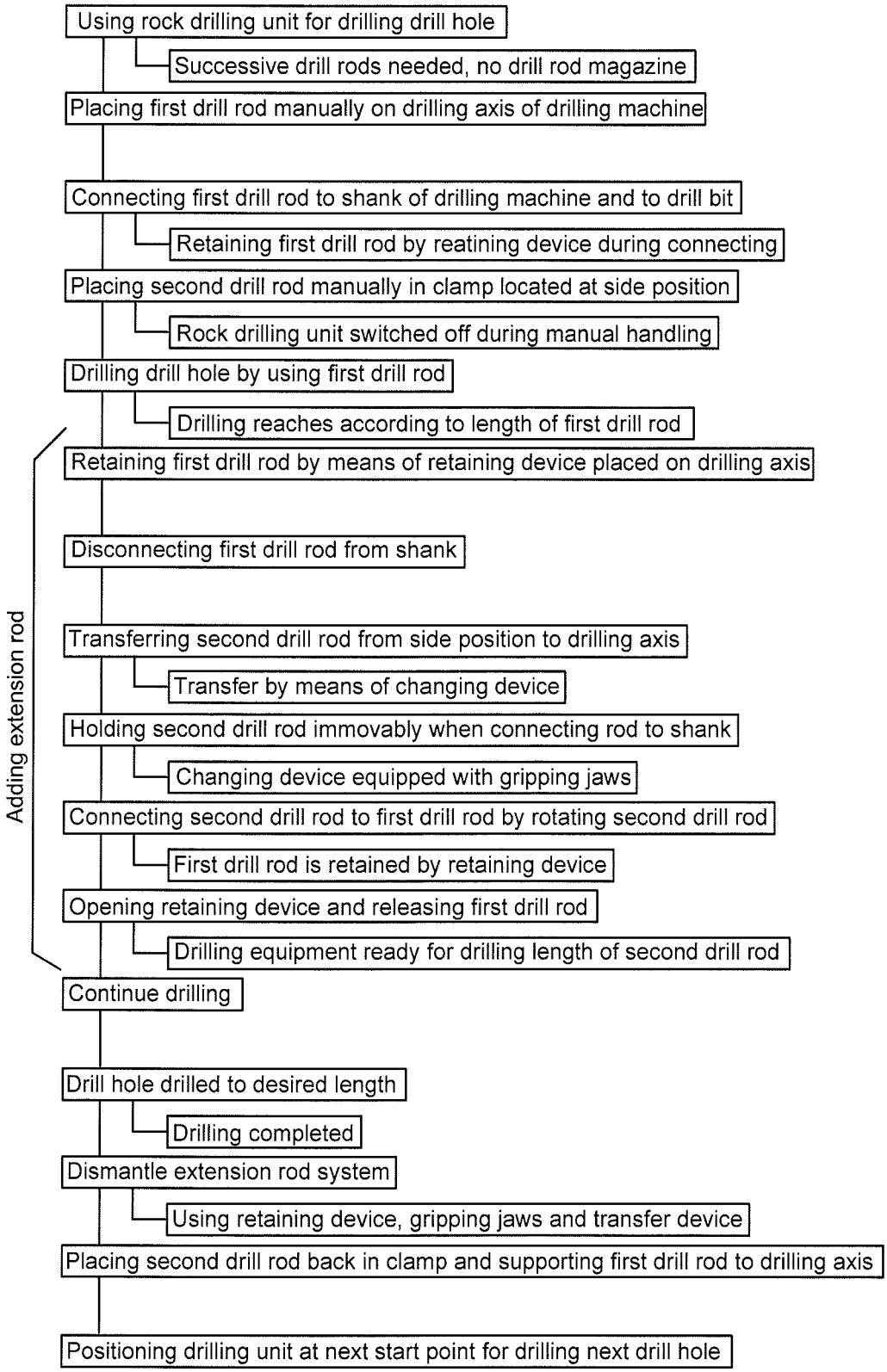
FIG. 8 is a simplified chart showing features relating to changing of drill rods according to principles disclosed above.

In FIG. 8, it is shown a simplified chart of steps relating to changing of drill rods, as discussed above.

Although the present embodiment(s) has been described in relation to particular aspects thereof, many other variations and modifications and other uses will become apparent to those skilled in the art. It is preferred therefore, that the present embodiment(s) be limited not by the specific disclosure herein, but only by the appended claims.

What is claimed is:

1. A rock drilling unit comprising:

a feed beam, which is an elongated piece;

a rock drilling machine arranged movably on the feed beam and defining a drilling axis, whereby the rock drilling machine includes a shank for connecting a drill rod to the drilling axis;

means for moving the drill rod in a transverse direction relative to the drilling axis;

at least one retainer device arranged on the feed beam and located on the drilling axis; and at least one clamp having a retaining feature allowing one single drill rod at a time to be retained at a predetermined side position, which is parallel to the drilling axis and is located at a transverse distance from the drilling axis, the clamp including contact surfaces which are pressed against a retained drill rod placed between the contact surfaces, the clamp being spring-actuated, wherein the retaining feature of the clamp is independent of a driving force external to the clamp.

2. The rock drilling unit as claimed in claim 1, wherein the at least one clamp includes at least one spring element.

3. The rock drilling unit as claimed in claim 1, wherein the clamp is supported by the feed beam by means of at least one support element, the clamp being immovably arranged in the predetermined side position.

4. The rock drilling unit as claimed in claim 1, wherein the clamp is movable in the transverse direction of the feed beam from the side position to the drilling axis, and vice versa.

5. The rock drilling unit as claimed in claim 4, further comprising a support arm pivotally connected to the feed beam, the clamp being arranged at a distal end portion of the support arm and wherein the support arm is provided with a turning device for turning the support arm in the transverse direction relative to the feed beam from the side position to the drilling axis and vice versa.

6. The rock drilling unit as claimed in claim 1, wherein the means for moving the drill rod comprises at least one changing device including a body connected movably to the feed beam; gripping means for allowing the drill rods to be gripped and released; and at least one transfer device for moving the at least one changing device in the transverse direction relative to the feed beam and for positioning the gripping means at the side position and the drilling axis.

7. The rock drilling unit as claimed in claim 6, wherein the at least one changing device includes openable and closable gripping jaws serving as the gripping means.

8. The rock drilling unit as claimed in claim 6, wherein the clamp is arranged to support the drill rod at the side position and the at least one changing device is arranged to move the drill rod between the side position and the drilling axis.

9. The rock drilling unit as claimed in claim 6, wherein the clamp is supported by the at least one changing device, whereby the clamp is transversally movable together with the at least one changing device.

10. The rock drilling unit as claimed in claim 9, wherein the clamp is arranged to be pivoted relative to the body of the at least one changing device.

11. The rock drilling unit as claimed in claim 9, wherein the clamp serves as the gripping means of the at least one changing device.

12. The rock drilling unit as claimed in claim 9, wherein the gripping means comprises gripping jaws, the clamp holding the drill rod at the side position when the gripping jaws are open.

13. The rock drilling unit as claimed in claim 1, wherein the at least one clamp is made of a resilient material that provides a spring actuation force.

14. A method of changing drill rods in a rock drilling unit, the rock drilling unit including a feed beam, a rock drilling machine and at least one retainer device, the method comprising the steps of:

connecting at least two drill rods together at a drilling axis of the drilling machine for forming an extension rod assembly when the rock drilling unit is in an inoperational state;

dismantling the extension rod assembly after a drilling procedure;

holding the extension rod assembly by the retainer device, wherein the connecting and dismantling includes moving the drill rods in a transverse direction relative to the feed beam between the drilling axis and at least one side position, wherein the at least one side position is parallel to the drilling axis and is located at a distance from the drilling axis; and supporting one single drill rod at a time at the at least one side position by at least one clamp, wherein the drill rods are fed manually to the clamp when the rock drilling unit is off and the drill rods are retained in the clamp by an internal spring force.

15. The method as claimed in claim 14, further comprising the steps of moving the drill rods between the drilling axis and the side position by means of a changing device arranged to be transversally movable relative to the feed beam; and moving the clamp between the drilling axis and the side position together with the changing device.

* * * * *